US008345910B2

(12) United States Patent
Chae et al.

(10) Patent No.: US 8,345,910 B2
(45) Date of Patent: Jan. 1, 2013

(54) MICROPHONE DEVICES AND METHODS FOR TUNING MICROPHONE DEVICES

(75) Inventors: Junseok Chae, Phoenix, AZ (US); Michael Kozicki, Phoenix, AZ (US)

(73) Assignee: Arizona Board of Regents, Scottsdale, AZ (US)

( * ) Notice: Subject to any disclaimer, the term of this patent is extended or adjusted under 35 U.S.C. 154(b) by 261 days.

(21) Appl. No.: 12/743,374

(22) PCT Filed: Oct. 15, 2008

(86) PCT No.: PCT/US2008/080036

§ 371 (c)(1), (2), (4) Date: Aug. 12, 2010

(87) PCT Pub. No.: WO2009/064577

PCT Pub. Date: May 22, 2009

(65) Prior Publication Data

US 2011/0038497 A1 Feb. 17, 2011

Related U.S. Application Data

(60) Provisional application No. 60/988,800, filed on Nov. 18, 2007.

(51) Int. Cl.
*H04R 9/08* (2006.01)

(52) U.S. Cl. ..... 381/358

(58) Field of Classification Search ..... 381/358, 381/355

See application file for complete search history.

(56) References Cited

U.S. PATENT DOCUMENTS

| | | | | |
|---|---|---|---|---|
| 3,433,959 | A | 3/1969 | Atwood et al. | |
| 4,926,696 | A | 5/1990 | Haritonidis et al. | |
| 6,483,619 | B1 | 11/2002 | Greywall | |
| 6,635,914 | B2 | 10/2003 | Kozicki et al. | |
| 7,116,430 | B2 | 10/2006 | Degertekin et al. | |
| 7,146,014 | B2 | 12/2006 | Hannah | |
| 7,778,062 | B2 * | 8/2010 | Toda et al. | 365/148 |
| 2002/0171636 | A1 * | 11/2002 | Aarts et al. | 345/177 |
| 2004/0099799 | A1 | 5/2004 | Shinzou | |
| 2004/0252930 | A1 | 12/2004 | Gorelik et al. | |
| 2005/0052724 | A1 | 3/2005 | Suzuki et al. | |
| 2005/0219787 | A1 * | 10/2005 | Stevenson et al. | 361/302 |
| 2005/0225413 | A1 | 10/2005 | Kozicki et al. | |

(Continued)

OTHER PUBLICATIONS

J. J. Yao et. al, "A micromachined, single-crystal silicon tunable resonator" J. Microelectromech. Syst., vol. 6, pp. 257-264, 1996.

(Continued)

*Primary Examiner* — Forrest M Phillips

(74) *Attorney, Agent, or Firm* — McDonnell Boehnen Hulbert & Berghoff LLP

(57) ABSTRACT

The present invention relates generally to microphone devices useful, for example, in hearing aid devices. The present invention relates more particularly to tunable microphone devices, and methods used to tune them. One aspect of the present invention is a microphone device that includes at least one microphone element. Each microphone element comprises a diaphragm suspended by a substrate; a solid electrolyte disposed on the diaphragm; an anode electrically coupled to the solid electrolyte; and a cathode electrically coupled to the solid electrolyte. The solid electrolyte is disposed between the anode and the cathode, such that ions flowing from the anode to the cathode travel through the solid electrolyte and electrons can flow in the opposite direction.

19 Claims, 14 Drawing Sheets

U.S. PATENT DOCUMENTS

2007/0025570 A1* 2/2007 Yonehara et al. ..... 381/174
2009/0173426 A1* 7/2009 Japp et al. ..... 156/60

OTHER PUBLICATIONS

W. Zhang et. al, "Tuning the dynamic behavior of parametric resonance in a micromechanical oscillator," Appl. Phys. Lett. 82, 130 (2003).

M. N. Kozicki et. al, "Mass transport in chalcogenide electrolyte films—materials and applications," Journal of Non-Crystalline Solids, vol. 352, pp. 567-577, 2006.

S. Jun et. al, "Electrothermal frequency tuning of a nano-resonator," Electronics Letters, 42(25), Dec. 7, 2006, p. 1484-5.

D. Joachim et. al, "Characterization of selective polysilicon deposition for MEMS resonator tuning," Journal of MEMS, 12(2), p. 193-200, 2003.

N. A. Hall et al., "Micromachined microphones with diffraction-based optical displacement detection", J. Acoust. Soc. Am. 118(5) Nov. 2005.

W. Cui et al., "Optical Sensing in a Directional MEMS Microphone Inspired by the Ears of the Parasitoid Fly, Ormia Ochracea", MEMS 2006, Istanbul, Turkey Jan. 22-26, 2006.

D.W. Carr, "MEMS and Optoelectronics Integration for Physical Sensors" abstract Symphony Acoustics, Inc. Conference: 2007.

DS Greywall, "Micromachined Optical Interference Microphone" Sens. Actuators. vol. 75, pp. 257-268, 1999.

O Solgard et al., "Deformable Grating Optical Modulator". Opt. Lett. vol. 17 pp. 688-690, 1992.

SC Thompson et al., Noise in miniature microphones. J. Acoust. Soc. Am. vol. 111 pp. 861-866, 2002.

TB Gabrielson, Mechanical-Thermal Noise in Micromachined Acoustics and Vibration Sensors. IEEE Trans. Electron. Dev. vol. 40, pp. 903-909.

W. Lee et al., Fabrication and Characterization of a Micromachined Acoustic Sensor With Integrated Optical Readout. J. Sel. Topics. Quantum Electron. vol. 10 pp. 643-651, 2004.

Sagberg et al., Optical Microphone Based on a Modulated Diffractive Lens. IEEE Phot. Tech. Let. vol. 15 pp. 1431-1433, 2003.

DW Carr et al., Laterally Deformable nanomechanical zero-order gratings: Anomalous diffraction studied by rigorous coupled wave analysis. Opt. Lett. vol. 28, pp. 1636-1638, 2003.

S. Je and J. Chae, "An electromagnetically actuated micromachined loud- speaker for hearing aids applications," in Proc. IEEE Sensors, 2007, pp. 1024-1027.

J. Rehder, P. Rombach, and O. Hansen, "Balanced membrane micromachined loudspeaker for hearing instrument application", J. Micromech. Microeng., vol. 11, No. 4, pp. 334-338, Jul. 2001.

A. Harradine, T. S. Birch, J. C. Stevens, and C. Shearwood, "A micro-machined loudspeaker for the hearing impaired," in Proc. IEEE Int. Trans- ducers, 1997, pp. 429-432.

C. Shearwood, M. A. Harradine, T. S. Birch, and J. C. Stevens, "Applications of polyimide membrane to MEMS technology," Microelectron. Eng., vol. 30, pp. 547-550, 1996.

M. Cheng, W. Huang, and S. R. Huang, "A silicon microspeaker for hearing instruments," J. Micromech. Microeng., vol. 14, No. 7, pp. 859-866, Jul. 2004.

ISR for PCT/US2008/080036, mailed Dec. 15, 2008.

* cited by examiner (a) Top electrode and parylene membrane (Mask #1, 2)

(b) Deposit GeSe think film and Ag (Mask #3)

(c) Ag photo-dissolution (d) Two electrodes on GeSe/Ag film (Mask #4, 5)

(e) Bottom electrode (Mask #6)

(f) Back side etch and sacrificial oxide etch (Mask #7)

MICROPHONE DEVICES AND METHODS FOR TUNING MICROPHONE DEVICES

CROSS-REFERENCE TO RELATED APPLICATIONS

This application claims priority to U.S. Provisional Patent Application Ser. No. 60/988,800, filed Nov. 18, 2007, which is hereby incorporated herein by reference in its entirety.

BACKGROUND OF THE INVENTION

1. Field of the Invention

The present invention relates generally to microphone devices useful, for example, in hearing aid devices. The present invention relates more particularly to tunable microphone devices, and methods used to tune them.

2. Technical Background

Microphone devices generally include a diaphragm that is somewhat flexible and moveable by acoustic force. However, manufacturing diaphragms with well-defined responses is relatively difficult. In particular, nanoscale statistical irregularities caused by the nature of the materials of the diaphragms and manufacturing variations in deposition, lithography, and etch methods lead to significant variation in mass and stiffness. The variations in mass and stiffness, in turn, lead to differences of the responses of the diaphragms and of the microphone elements and devices in which they are used. Moreover, environmental factors such as oxidation, condensation of airborne vapors and contamination can alter the diaphragm after the structure has been fabricated.

Directional microphone devices generally include two or more microphone elements closely matched in response. However, fabrication of closely matched microphone elements can be difficult due to manufacturing variations. Even a small difference in response, e.g., as little as 0.2 dB, can destroy directionality completely. Electronic calibration and compensation can also be used to achieve directionality, but such methods are very complex, require large systems and large power consumption, and lead to high costs. Manually selecting matched microphone elements can provide limited success, but matching involves high cost and requires additional matching after installation of the device.

Directional microphone devices are used, for example, as the basis for hearing aid devices. Hearing aids are, however, not a one-size-fits-all solution to hearing problems. A patient's level or type of hearing impairment and/or physical condition can impact sound delivery within the ear, making a universal fit impossible. Moreover, in order to fully support a wearer's needs, tuning to adjust signal-to-noise ratio and directionality is generally desired. Accordingly, hearing aids must be uniquely tuned for each patient. There currently exist no low-cost, effective methods for in situ tuning.

Accordingly, there remains a need for microphone devices and directional microphone devices with well-defined and tunable response characteristics.

SUMMARY OF THE INVENTION

One aspect of the present invention is a microphone device that includes at least one microphone element. Each microphone element comprises a diaphragm suspended by a substrate; a solid electrolyte disposed on the diaphragm; an anode electrically coupled to the solid electrolyte; and a cathode electrically coupled to the solid electrolyte. The solid electrolyte is disposed between the anode and the cathode, such that ions flowing from the anode to the cathode travel through the solid electrolyte and electrons can flow in the opposite direction.

Another aspect of the invention is a method for tuning a microphone device comprising at least one microphone element, each microphone element comprising a diaphragm suspended by a substrate; a solid electrolyte disposed on the diaphragm; an anode electrically coupled to the solid electrolyte; and a cathode electrically coupled to the solid electrolyte. The solid electrolyte is disposed between the anode and the cathode, such that ions flowing from the anode to the cathode travel through the solid electrolyte and electrons can flow in the opposite direction. The method comprises creating an electrical bias between the anode and the cathode to deposit a dendritic metallic structure extending from the cathode onto the solid electrolyte, or to increase the concentration of metal in the solid electrolyte. Moreover, the method can also (or alternatively) include creating a reverse electrical bias between the anode and the cathode to remove material from the dendritic metallic structure, or to decrease the concentration of metal in the solid electrolyte.

Another aspect of the invention is a directional microphone device comprising a substrate and at least two microphone elements, each microphone element comprising a diaphragm suspended by the substrate. Each microphone element can further comprise a layer of solid a layer of solid electrolyte disposed on the diaphragm; an anode electrically coupled to the solid electrolyte; and a cathode electrically coupled to the solid electrolyte, wherein the solid electrolyte is disposed between the anode and the cathode.

DETAILED DESCRIPTION OF THE INVENTION

Figure 1:
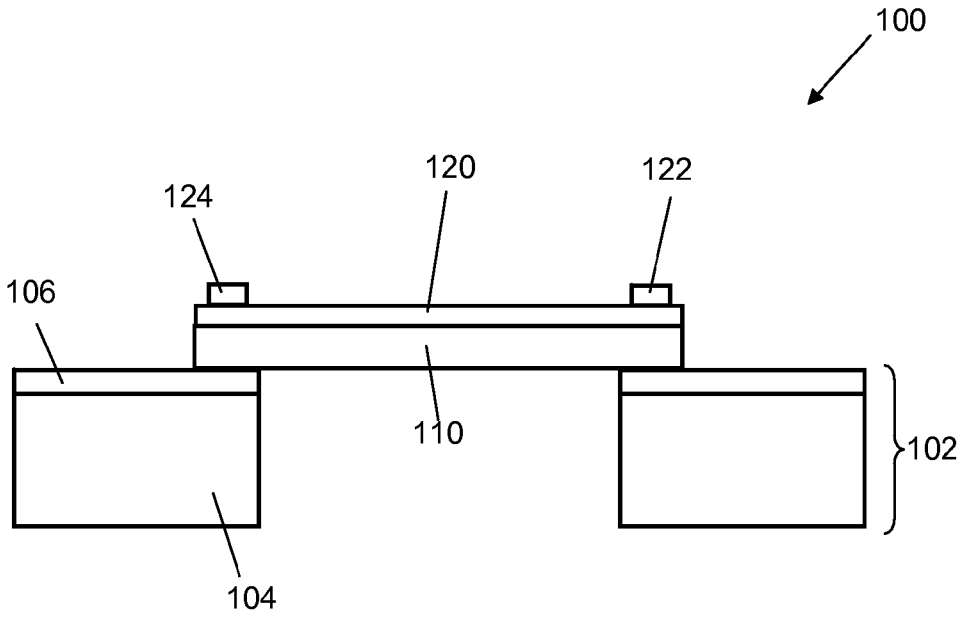
FIG. 1 is a schematic cross-sectional view of a microphone element according to one embodiment of the invention.

An example of a microphone element according to one embodiment of the invention is shown in schematic cross-sectional view in FIG. 1. Microphone element 100 includes substrate 102. In the embodiment shown in FIG. 1, substrate 102 is a silicon wafer 104 having a silicon oxide 106 coating formed thereon. A diaphragm 110 is suspended by the substrate. The diaphragm can be formed from a variety of materials. For example, in the device of FIG. 1, the diaphragm can be formed from parylene. Of course, other materials, such as conductors (e.g., metals), semiconductors (e.g., silicon) or insulators (e.g., polymeric materials such as polyimide) can be used. The diaphragm can be, for example, in the range of 1-50 μm in thickness. Formed on the diaphragm is a layer of solid electrolyte 120. An anode 122 and a cathode 124 are electrically coupled to the layer of solid electrolyte 120. In the embodiment of the invention shown in FIG. 1, the anode and cathode are disposed on the solid electrolyte; however, in other embodiments of the invention, the anode and cathode can be disposed elsewhere. In certain embodiments of the invention, the cathode is disposed within 100 μm of the suspended area of the diaphragm.

When perturbations of the diaphragm are to be detected using capacitance measurements, the diaphragm can include at least one conductive film. For example, in one embodiment of the invention, the diaphragm can have a multilayer structure comprising at least one conductive film.

Figure 2:
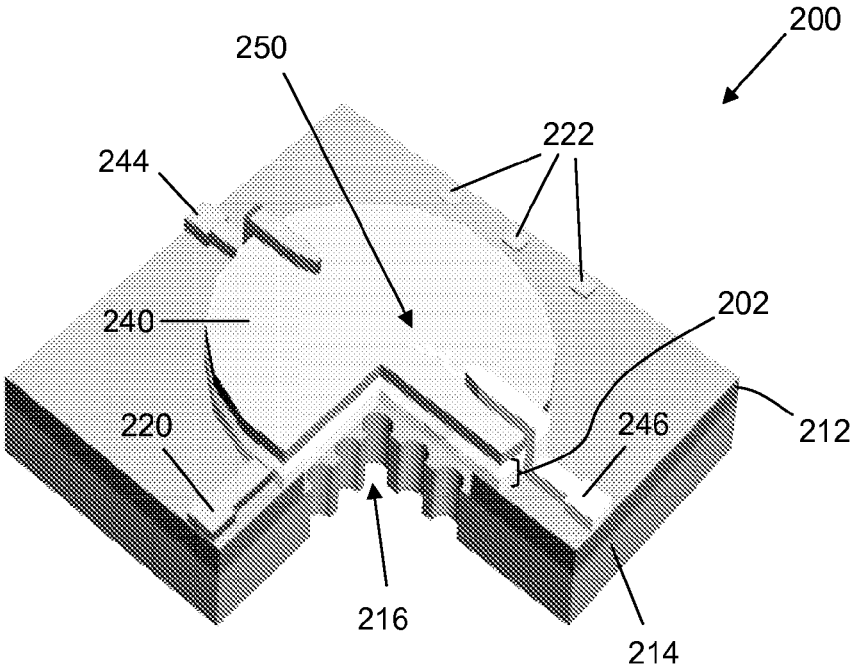
FIG. 2 is a schematic cut-away perspective view of a capacitive microphone element according to another embodiment of the invention.
Figure 3:
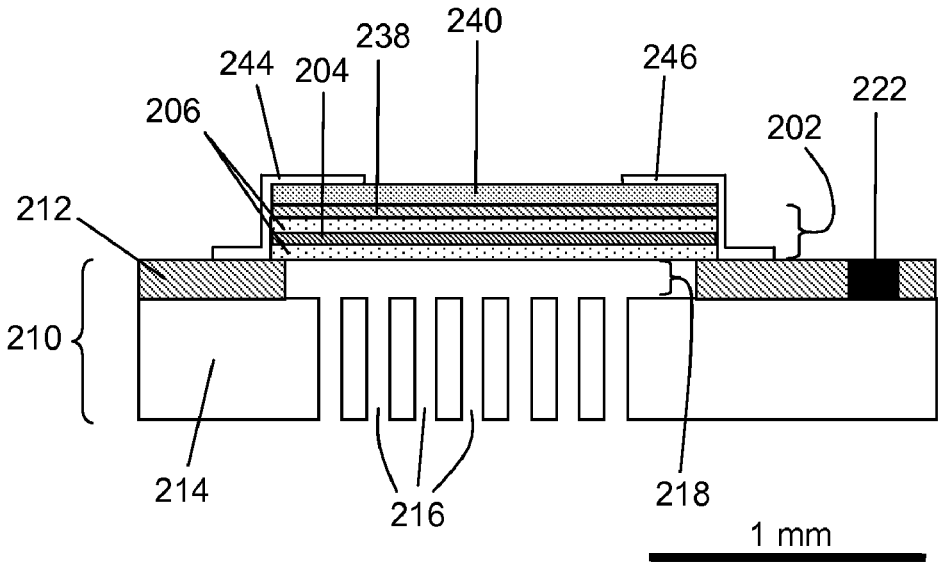
FIG. 3 is a schematic cross-sectional view of a capacitive microphone element according to another embodiment of the invention.

One embodiment of a capacitive microphone element according to one embodiment of the invention is shown in schematic cut-away perspective view in FIG. 2, and in schematic cross-sectional view in FIG. 3. In the capacitive microphone element 200 of FIGS. 2 and 3, a multilayer diaphragm 202 includes a conductive layer (in this example, gold layer 204) disposed between two layers of substantially non-conductive material (in this example, layers 206 of parylene). Diaphragm 202 is suspended by a substrate 210, which in this embodiment of the invention consists of a thin (e.g., ~1 μm) layer of $SiO_2$ 212 on a doped silicon backplate 214. The silicon backplate has a series of holes 216 formed therein, defining a region in which the $SiO_2$ layer of the substrate has been etched away, leaving the diaphragm suspended by the substrate over a thin (e.g., ~1 μm) layer of air 218. The conductive layer of the diaphragm is operatively coupled to top electrode 220, and the silicon backplate is operatively coupled to a bottom electrode 222. Electrodes 220 and 222 can be coupled to a capacitive readout circuit, which is described in more detail below, to allow capacitive sensing of acoustic vibration of the diaphragm 202. A thin (e.g., submicron) layer 238 of $SiO_2$ is formed on the top parylene layer of the diaphragm, upon which a solid electrolyte layer 240 (e.g., an Ag-doped $Ge_{30}S_{70}$ film) is disposed. Anode 244 and cathode 246 are disposed on the solid electrolyte layer.

The microphone elements of the present invention can be tuned to achieve a desired response through electrodeposition from the anode onto and/or into the solid electrolyte layer. For example, the microphone elements of the present invention can be tuned by forming a dendritic metallic structure on the solid electrolyte layer and/or by increasing the concentration of metal in the solid electrolyte layer, through electrodeposition from the solid state. During a tuning operation, mechanical properties of the diaphragm can be altered by applying a bias greater than a threshold voltage ($V_T$), discussed in more detail below, across the anode and the cathode, which is sufficient to cause conductive material along the layer of solid electrolyte to migrate. For example, as a voltage $V>V_T$ is applied across the anode and the cathode, conductive material migrates through or on a portion of the layer of solid electrolyte to form an electrodeposit at or near the cathode (250 in FIG. 2). The term "electrodeposit" as used herein means any area within or on the layer of solid electrolyte that has an increased concentration of reduced metal or other conductive material compared to the concentration of such material in the bulk ion conductor material. Electrodeposits can have significant growth parallel to as well as normal to the electrolyte surface. In the absence of any insulating barriers, which are discussed in more detail below, the threshold voltage required to grow the electrodeposit is approximately the potential at which oxidation of the anode and metal ion reduction at the cathode occurs of the system, typically a few hundred millivolts. If an opposite bias is applied, the electrodeposit can dissolve back into the ion conductor, and be plated back onto the anode.

Figure 4:
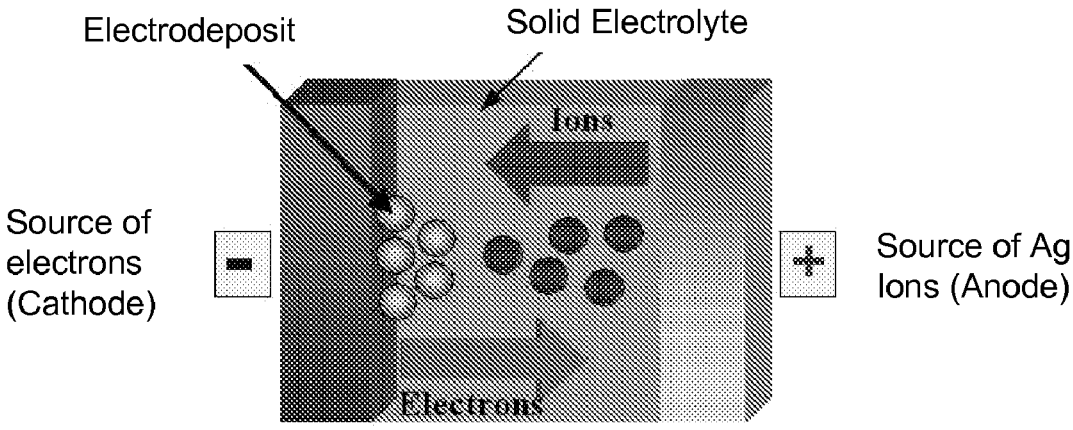
FIG. 4 is an illustration of an electrodeposition process in solid electrolyte.

Accordingly, in one embodiment of the invention, the microphone device further includes a dendritic metallic structure extending from the cathode onto the solid electrolyte. This technique is analogous to electrodeposition in liquid electrolyte, but instead uses the layer of solid electrolyte, as shown in FIG. 4. The layer of solid electrolyte can be, for example, an Ag-rich Ge—Se material, which allows $Ag^+$ ions to move from the anode (in this example, made of silver) toward the cathode upon application of a voltage (e.g., a few hundred mV or more). $Ag^+$ ions reaching the cathode are reduced to form the dendritic metallic structure, which grows and extends from the cathode out onto the solid electrolyte. The amount of electrodeposited material (i.e., metal in excess of the starting composition of the electrolyte) is determined by factors such as the applied voltage, the ion current magnitude and the time the current is allowed to flow. The dendritic metallic structure alters the response of the diaphragm to sound. For example, the dendritic metallic structure and its associated mass redistribution can cause the surface of the diaphragm to become rough and heterogeneous, and can alter its mechanical stress bending stiffness and displacement characteristics. This technique is non-volatile and low in power, and can allow precise control of the response characteristics of the microphone element. Moreover, it can be reversible; by reversing the potential between the anode and the cathode, a dendritic metallic structure can be slowly dissolved and re-plated onto the anode. Accordingly, response of the microphone element can be tuned in both directions. This calibration technique can be performed at any stage during the life of the device, even after packaging, or time in use. For example, calibration can be performed in a hearing aid comprising a microphone according to the present invention even while the hearing aid is in a patient's ear, and at virtually any time during the service lifetime of the hearing aid.

The dendritic metallic structure can be formed from a variety of metallic materials. For example, in one embodiment of the invention, the dendritic metallic structure is formed from silver. Dendritic metallic structures can also be formed from copper, zinc or iron.

Accordingly, another aspect of the invention is a method for tuning the microphone device described above. The method can comprise creating an electrical bias between the anode and the cathode to deposit a dendritic metallic structure extending from the cathode onto the solid electrolyte. Alternatively (or additionally), the method can comprise creating an electrical bias between the anode and the cathode to increase the concentration of metal in the solid electrolyte layer. Moreover, the method can also (or alternatively) include creating a reverse electrical bias between the anode and the cathode to remove material from the dendritic metallic structure. Alternatively (or additionally), the method can comprise creating a reverse electrical bias between the anode and the cathode to decrease the concentration of metal in the solid electrolyte layer. The methods can be performed while measuring the response of the device.

In one embodiment of the invention, the anode is formed of a material including a metal that dissolves in the layer of solid electrolyte when a sufficient bias ($V>V_T$) is applied across the anode and the cathode. The cathode can be relatively inert and generally does not dissolve during the tuning operation. For example, the anode can be formed from a material including silver that dissolves in the solid electrolyte, and the cathode can be formed from an inert material such as aluminum, tungsten, nickel, molybdenum, platinum, gold, chromium, palladium, copper, all their alloys and metal silicides, doped silicon, and the like. Having the anode formed of a material including a metal which dissolves in the solid electrolyte facilitates maintaining a desired dissolved metal concentration within the solid electrolyte, which in turn facilitates rapid and stable electrodeposit formation. Furthermore, use of an inert material for the cathode can facilitate electrodissolution of any electrodeposit that may have formed. The anode can also include copper, zinc, or iron when electrodeposits of these metals are to be formed; the person of skill in the art can select appropriate cathode materials based on the necessary electrodeposition conditions. Various configurations of solid electrolyte suitable for use with the present invention are discussed, for example, in U.S. Pat. No. 6,635,914.

The substrate may include semiconductor, conductive, semi-insulative or insulating material, or any combination of such materials. In accordance with one embodiment of the invention, the substrate includes a semiconductor material such as silicon as is commonly used in the manufacture of semiconductor devices. Because the microphone elements of the present invention can be formed over insulating or other materials, the structures are easily integrated with microelectronic or other devices and are particularly well suited for applications where substrate (e.g., semiconductor material) space is a premium. In certain embodiments of the invention in which capacitive sensing is to be used, the substrate is a doped silicon wafer.

The solid electrolyte is formed from a material that conducts ions upon application of a sufficient voltage. In one embodiment of the invention, the layer of solid electrolyte has a thickness less than 200% of the thickness of the diaphragm. Suitable materials for the solid electrolyte include glasses, plastics, and semiconductor materials.

In one embodiment of the invention, the solid electrolyte is formed of a chalcogenide material.

The solid electrolyte can also include dissolved conductive material. For example, the solid electrolyte may comprise a solid solution that includes dissolved metals and/or metal ions. In accordance with one embodiment of the invention, the solid electrolyte includes metal and/or metal ions dissolved in chalcogenide glass. An exemplary chalcogenide glass with dissolved metal in accordance with the present invention includes a solid solution of $As_xS_{1-x}$—Ag, $Ge_xSe_{1-x}$—Ag, $Ge_xS_{1-x}$—Ag, $As_xS_{1-x}$—Cu, $Ge_xSe_{1-x}$—Cu, $Ge_xS_{1-x}$—Cu, where x ranges from about 0.1 to about 0.5, other chalcogenide materials including silver, copper, zinc, combinations of these materials, Ag- and Cu-doped transition metal oxides, Ag- and Cu-doped silicon or germanium oxides, and the like. Photodissolution techniques can be used to load metal and/or metal ions into the solid electrolyte.

In accordance with one particular embodiment of the invention, the solid electrolyte includes a germanium-selenide glass with about 30 to about 50 atomic percent silver diffused in the glass (e.g., $Ag_{33}Ge_{20}Se_{47}$). Such materials can be formed using evaporation. Additional ion conductor materials and methods of forming the ion conductor are discussed in U.S. Pat. No. 6,635,914.

Contacts (not illustrated) may suitably be electrically coupled the anode and/or cathode to facilitate forming electrical contact to the respective electrode. The contacts may be formed of any conductive material and are preferably formed of a metal such as aluminum, aluminum alloys, tungsten, or copper. In addition, structures and devices in accordance with the present invention may include additional insulating and/or encapsulating layers as are typically used in the manufacture of MEMS devices.

In one embodiment of the invention, the device includes one or more barrier layers, for example between the anode and the solid electrolyte and/or between the cathode and the solid electrolyte. Optional barrier layers can include a material that restricts migration of ions and/or that affects the threshold voltage required to form the electrodeposit. In accordance with certain embodiments of the invention, a barrier layer includes conducting material such as titanium nitride, titanium tungsten, a combination thereof, or the like. Use of a conducting barrier layer between the cathode and the solid electrolyte allows for the cathode to be formed of oxidizable material because the barrier prevents diffusion of the electrode material to the ion conductor. The diffusion barrier may also serve to prevent undesired electrodeposit growth within a portion of the structure. In accordance other embodiments of the invention, the barrier material includes an insulating material. Inclusion of an insulating material increases the voltage required to reduce the resistance of the device. In accordance with yet other embodiments of the invention, the barrier includes material that conducts ions, but which is relatively resistant to the conduction of electrons. Use of such material can reduce undesired plating at an electrode and increase the thermal stability of the device.

The microphone element can be used to detect sound using any of a number of detection schemes. For example, the diaphragm can be operatively coupled to a capacitive readout circuit as described below. In another embodiment of the invention, movement of the diaphragm is detected optically, for example through interferometry, as described in U.S. Pat. No. 4,926,696 or 6,483,619. Other detection mechanisms, such as piezoresistive, piezoelectric, tunneling, thermal and resonant mechanisms, may also be used.

Figure 5:
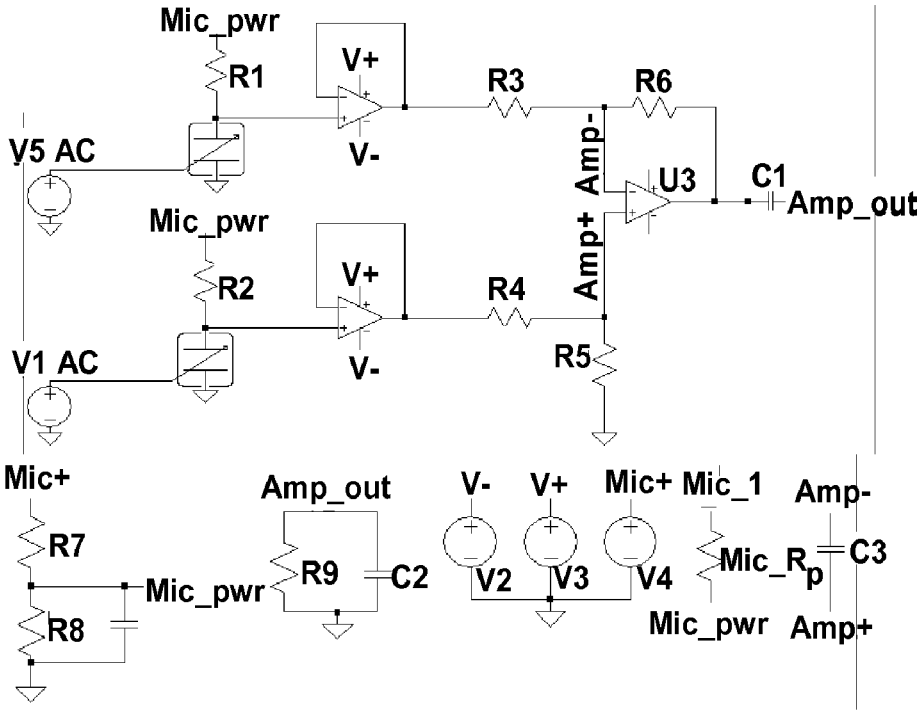
FIG. 5 is a schematic cross-sectional view of a directional microphone device according to one embodiment of the invention.

An example of a capacitive readout circuit (modeled as a voltage-controlled capacitor) is illustrated in FIG. 5. Without intending to be bound by theory, the operating principle is as follows: a small current passes across the high impedance bias resistor ($Mic_R_p$) to deposit a quantity of charge on the microphone; acoustic excitation changes the voltage of these electrons; the resulting voltage change translates to a displacement current to the positive amplifier terminal. Resistor values can be chosen such that approximately 100× amplification, and only AC passes through the output isolation capacitor (C1). This circuit can provide a passband starting at 0.1 kHz and ending at 200 kHz, and a peak capacitance to voltage conversion of 300 mV/pF for microphones with 20 pF base capacitance. This circuit can be used for differential measurement of two microphones to generate a directional output.

In one embodiment of the invention, the microphone device includes at least two of the microphone elements. The devices can be formed on a common substrate; or on different substrates and packaged together. Such microphone devices can provide directional detection of sound, and can be used, for example, in hearing aids. One or more of the microphone elements can have a dendritic metallic structure extending from its cathode onto its diaphragm; the dendritic metallic structures can be used to tune the microphone elements with respect to one another so that their performances are matched. For example, the responses of the microphone elements can be tuned to within 0.2 dB, or even 0.1 dB of one another. In certain embodiments of the invention, the more sensitive microphone is tuned to reduce its sensitivity to match that of the less sensitive microphone.

Figure 6:
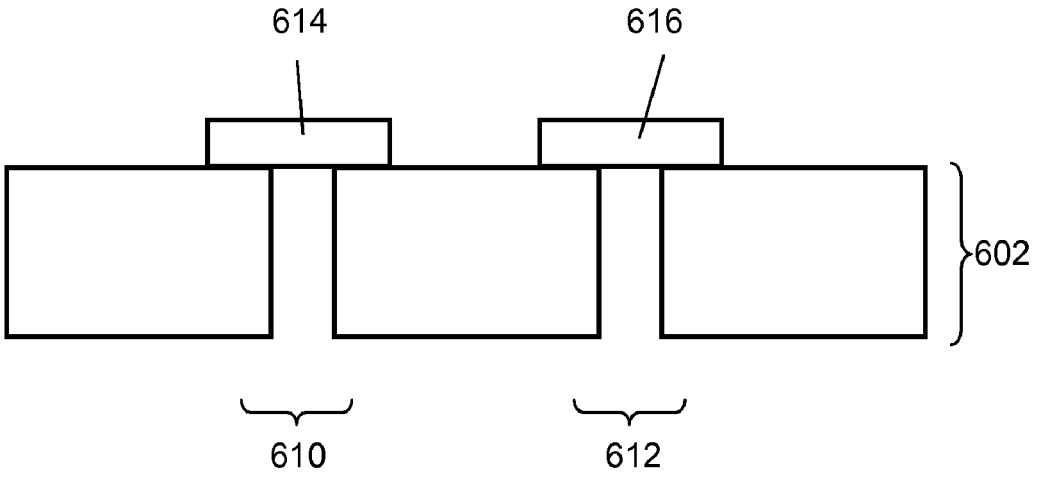
FIG. 6 is an illustration of an example of the fabrication of a microphone element according to one embodiment of the invention.

Another aspect of the invention is a directional microphone device comprising a substrate and at least two microphone elements, each microphone element comprising a diaphragm suspended by the substrate. For example, in the directional microphone device 600 of FIG. 6 includes a substrate 602 and two microphone elements 610 and 612, each of which includes a diaphragm 614 and 616 suspended by the substrate. Directional microphone devices according to this aspect of the invention can be using procedures analogous to those described below, and using standard semiconductor fabrication techniques. Integration of multiple microphone elements onto a single substrate can allow for the fabrication of miniaturized devices. Moreover, simultaneous fabrication of multiple microphone elements on a single substrate can provide microphone elements that are very closely matched in response, which can improve the performance of the directional microphone device and allow the individual microphone elements to be tuned very closely to one another.

In one embodiment of the invention, each microphone element further comprises a layer of solid electrolyte disposed on the diaphragm; an anode electrically coupled to the solid electrolyte; and a cathode electrically coupled to the solid electrolyte. Each solid electrolyte is disposed between the corresponding anode and cathode. The microphone elements according to this embodiment of the invention can have the structures described hereinabove. The microphone elements according to this embodiment of the invention can be tuned as described above to further match their responses. For example, in one embodiment of the invention, one or more of the microphone elements has a dendritic metallic structure extending from the cathode onto the solid electrolyte. The microphones can be individually tuned to achieve matched sensitivity; for example, one of the microphone elements can have a more extensive dendritic metallic structure on its solid electrolyte than another of the microphone elements. In certain embodiments of the invention, the responses of the microphone elements are within 0.1 dB of one another.

Another aspect of the invention is a hearing aid device comprising a hearing aid housing and at least one microphone device as described above disposed therein. For example, the hearing aid can comprise two microphone devices as described above. The hearing aid can comprise the directional microphone device as described above. The methods described herein can be used to tune the response of the microphone(s) of the hearing aid device. The hearing aid device can be, for example, an in-ear device. The hearing aid device can further comprise, for example, a capacitive readout circuit, as described above, operatively coupled to each microphone element.

Figure 7:
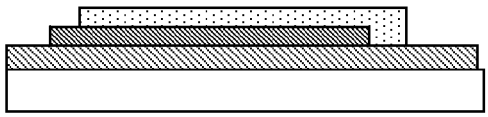
FIG. 7 is a schematic of a capacitive readout circuit for use with the microphone elements according to certain embodiments of the invention.
Figure 7:
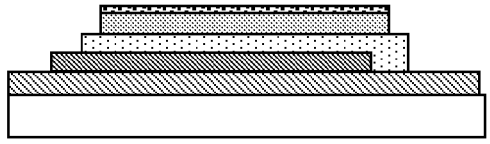
Figure 7:
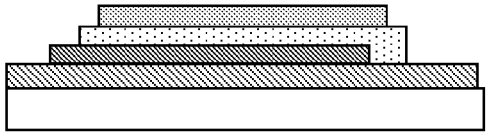
Figure 7:
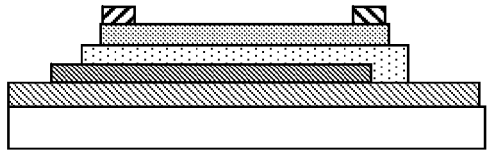
Figure 7:
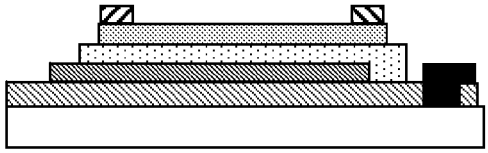
Figure 7:
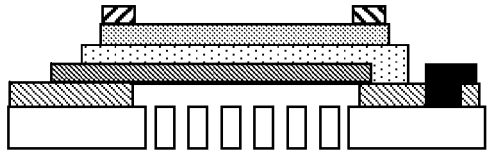
Figure 7:
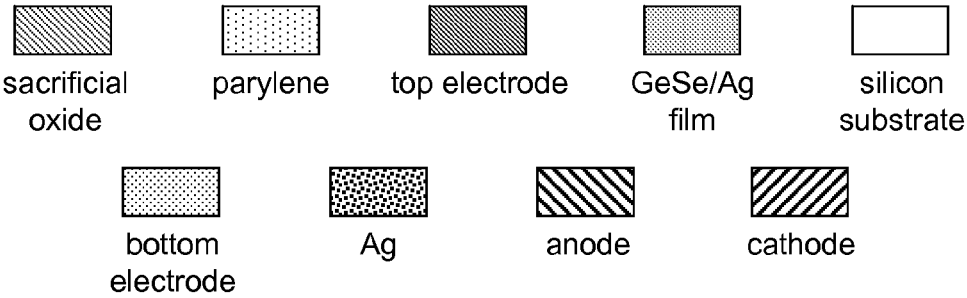

An example of the fabrication of a microphone element according to one embodiment of the invention is shown in FIG. 7. A conductive film (e.g., a layer of gold) and a nonconductive diaphragm layer (e.g., a layer of parylene) are formed on a $SiO_2$-on-Si substrate. A solid electrolyte is formed on the nonconductive diaphragm layer, then a conductive material (e.g., Ag) is dissolved into it. An anode (e.g., Ag) and cathode (e.g., Ni) are then evaporated and patterned to be electrodes to grow and retract nano-electrodeposits. A bottom electrode is also formed. The top and bottom electrodes are used in the capacitance-based measurement of the response of the microphone element. A series of through-holes are formed (e.g., via etching) through the back side of the Si substrate, then the $SiO_2$ is etched in the neighborhood of the holes, thereby releasing the membrane.

EXAMPLES

The invention can be further described by the following non-limiting Examples.

A microphone element according to the present invention was fabricated according to a procedure analogous to that described above with referenced to FIG. 6. In this microphone element, the suspended diaphragm has two layers of parylene films, a thin parylene layer underneath the top electrode, and a thicker parylene layer on top of the electrode. C-type parylene is used for the diaphragm material because of its excellent electrical/mechanical properties. The first parylene layer (3000-Å thick) is coated on a 1-μm thick sacrificial oxide layer on a silicon wafer to provide electrical isolation between the top and bottom electrodes. The parylene diaphragm is patterned by etching in an oxygen plasma for 1.5 min at an etch rate of 2000 Å/min under 15 sccm oxygen, 100 W RF power, and 500 V bias. A 3000 Å thick top electrode (Cr/Au) is then deposited and patterned on this first parylene layer. The second parylene layer (3 μm thick) is coated on the top electrode and patterned in oxygen plasma for 15 min. This second parylene layer is the main structural layer of the diaphragm. $Ge_{30}Se_{70}$ base glass (2400 Å thick) and silver layers (800 Å thick) are thermally evaporated and patterned on the diaphragm. The ratio of $Ge_{30}Se_{70}$ to Ag is approximately 3:1. Immediately after the deposition, photo-dissolution is performed using a 15 min UV exposure to diffuse silver into the $Ge_{30}Se_{70}$ layer to form the solid electrolyte. The anode (silver) and cathode (nickel) are separately evaporated and patterned on the diaphragm. (e) The bottom electrode is formed by removing the 1-μm thick oxide by a buffered oxide etchant for 50 min, and Cr/Au metal films are evaporated and patterned to access the silicon substrate. Finally, the diaphragm is defined by deep reactive ion etching ("DRIE") from the back side of the silicon wafer at an etch rate of 3 μm/min. The diaphragm is then released by using concentrated hydrofluoric acid for 15 min to remove the 1 μm sacrificial oxide layer. All metal patterning is performed by lift-off processing.

In one example of the fabrication of the solid electrolyte, a 50 nm layer of $Ge_{0.20\text{-}0.40}Se_{0.60\text{-}0.82}$ is first deposited onto the surface of the polysilicon material, and the Ge—Se layer is covered with about 20 nm of silver. The silver is dissolved into the Ge—Se glass by exposing the silver to a light source having a wavelength of about 405 nm and a power density of about 5 mW/cm$^2$ for about ten minutes. Any excess silver is then removed using a $Fe(NO_3)_3$ solution. The solid electrolyte material is then patterned and etched using RIE etching (e.g., $CF_4$+$O_2$) or wet etching (e.g., using NaOH:IPA:DI).

Figure 8:
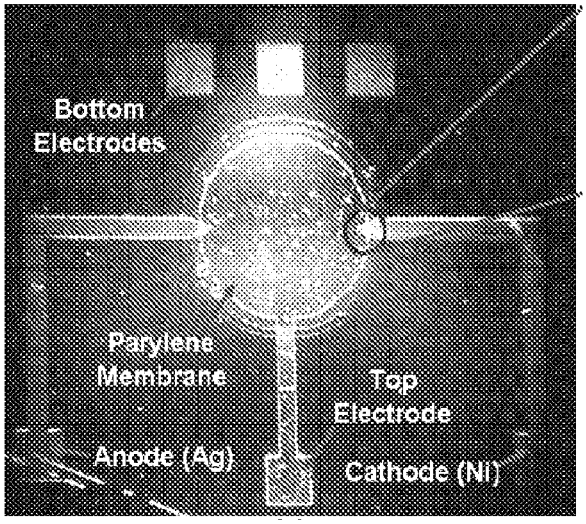
FIG. 8 is a top view of an example of a microphone element according to one embodiment of the invention.
Figure 9:
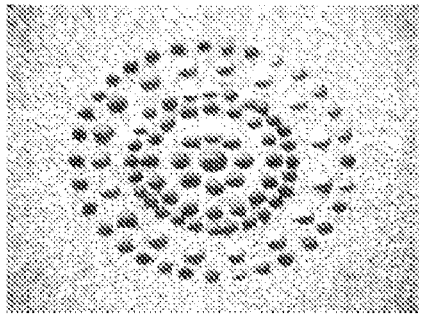
FIG. 9 is a backside view of the microphone element of FIG. 8.
Figure 10:
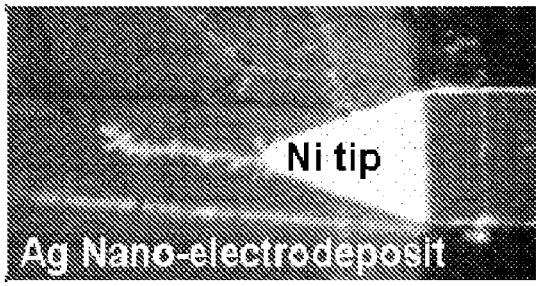
FIG. 10 is a magnified top view of the microphone element of FIG. 8 after tuning.
Figure 11:
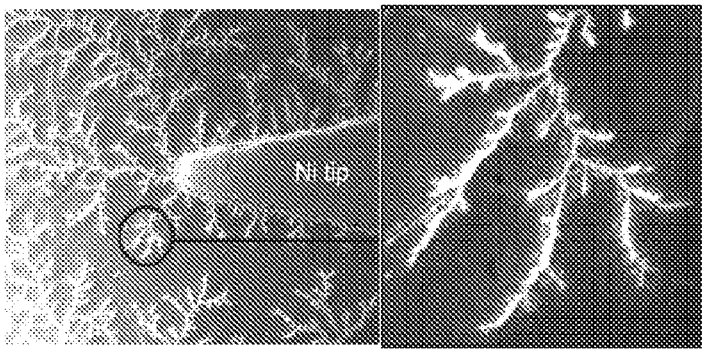
FIG. 11 is an SEM micrograph of an electrodeposited dendritic silver structure of FIG. 10.
Figure 12:
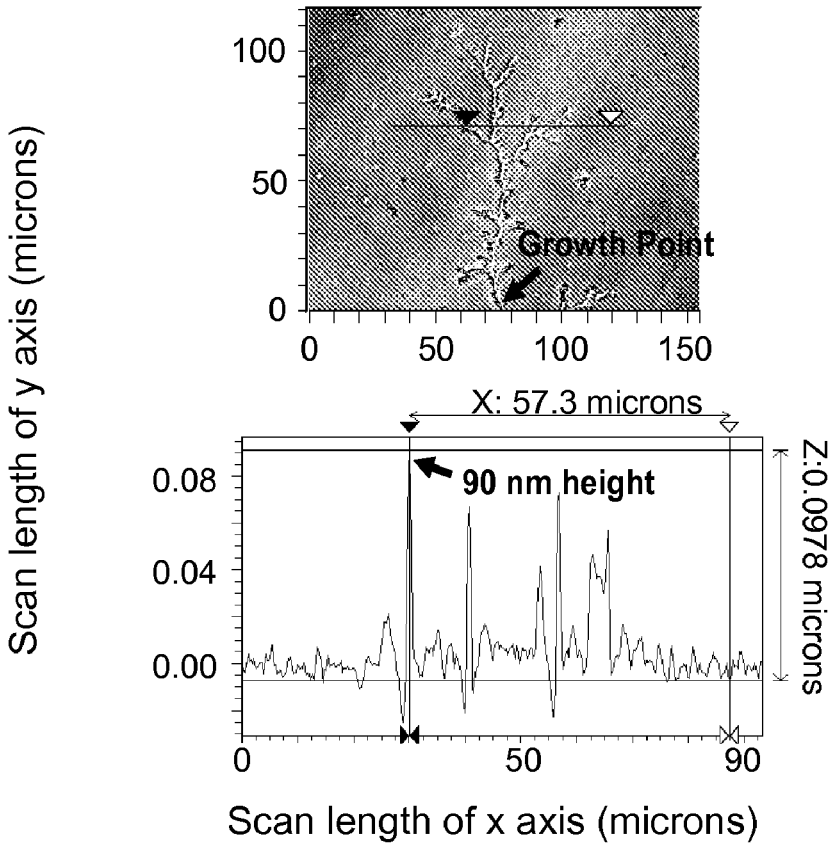
FIG. 12 is a set of optical profiles of the electrodeposited dendritic silver structure of FIG. 10.

The fabricated microphone element covered with the GeSe electrolyte is shown in FIG. 8. FIG. 9 shows the backside view of the microphone, and particularly the holes used to define the diaphragm. The DRIE-formed backplate is approximately 25% perforated. DC bias from 3 to 10 V was applied to electrochemically grow a dendritic silver structure extending out from the tip of the cathode, shown in FIG. 10. FIG. 11 shows SEM micrographs of the electrodeposited dendritic silver structure. A VEECO NT9800 optical profilometer was used to provide the optical profiles of FIG. 12, which show the dendritic silver structures to have a height on the order of 90 nm.

Figure 13:
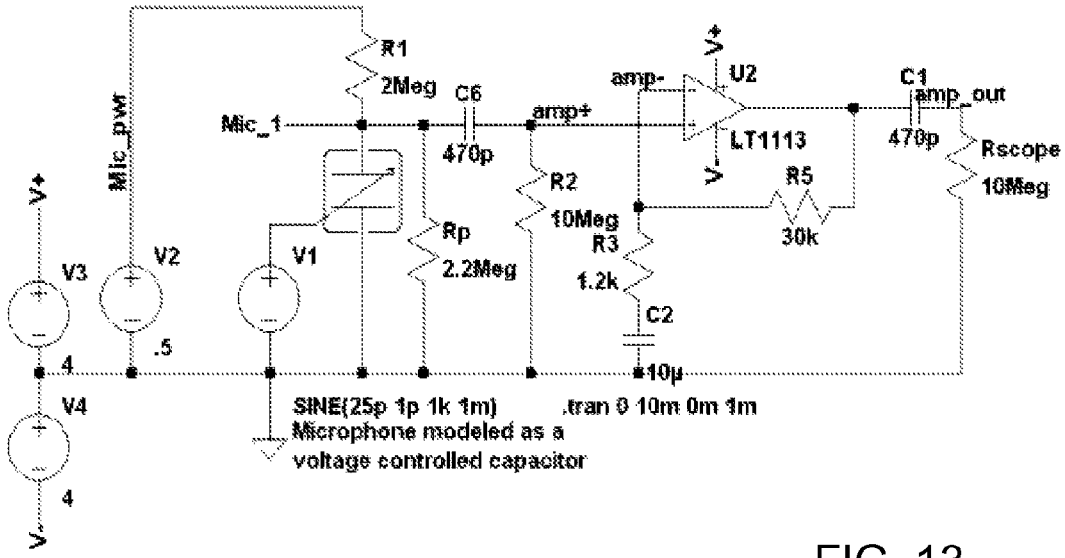
FIG. 13 is a schematic of the capacitive readout circuit used in measuring the microphone element of FIG. 8.

FIG. 13 shows the capacitive readout circuit used to test the tuning capability of the microphone. This circuit has a passband starting at 0.1 kHz and ending at 200 kHz, with a peak capacitance to voltage conversion of 300 mV/pF. The circuit operating principle is as follows: the capacitive microphone is biased by a high-impedance DC source (10 MΩ) to 250 mV. Acoustic excitation causes a change in microphone capacitance. The charged microphone diaphragm produces voltage change as the acoustic excitation actuates the diaphragm. The induced voltage change on the microphone passes through an isolation capacitor as displacement current, and is amplified by an AD8607 amplifier with 100× closed-loop gain. The response of the circuit shows both high and low frequency loss. The low frequency response of the circuit is limited by charge-retaining of the bias resistor. When the RC time constant is the same order of magnitude as the signal period, voltage discharge across the bias resistor dominates the circuit loss. The low frequency cutoff can be improved by using a larger resistor; however, doing so reduces the gain of the circuit. The bias resistor, 100 MΩ, balances the circuit bandwidth and peak output. At very high frequencies, the loss results from signal leakage as displacement current through the microphone.

Figure 14:
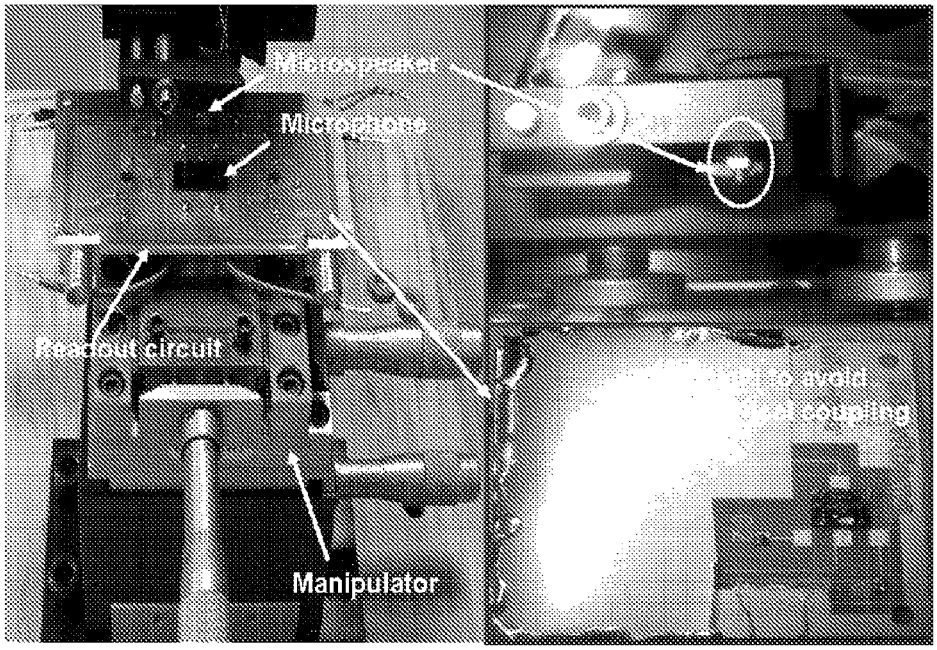
FIG. 14 is a view of the experimental setup used to measure the microphone element of FIG. 8.

The acoustic testing setup is shown in FIG. 14. The readout circuit and microphone elements are mounted on a PCB, which is mounted on a XYZ linear translation stage in a Faraday cage to minimize electromagnetic noise. The microphone element is excited acoustically by a Knowles FK-6260 microspeaker aligned precisely 4 mm above the microphone using the linear translation stages. A signal generator providing up to 0.5 V drives the microspeaker. The circuit output is measured using an Agilent 35670a Dynamic Signal Analyzer.

Figure 15:
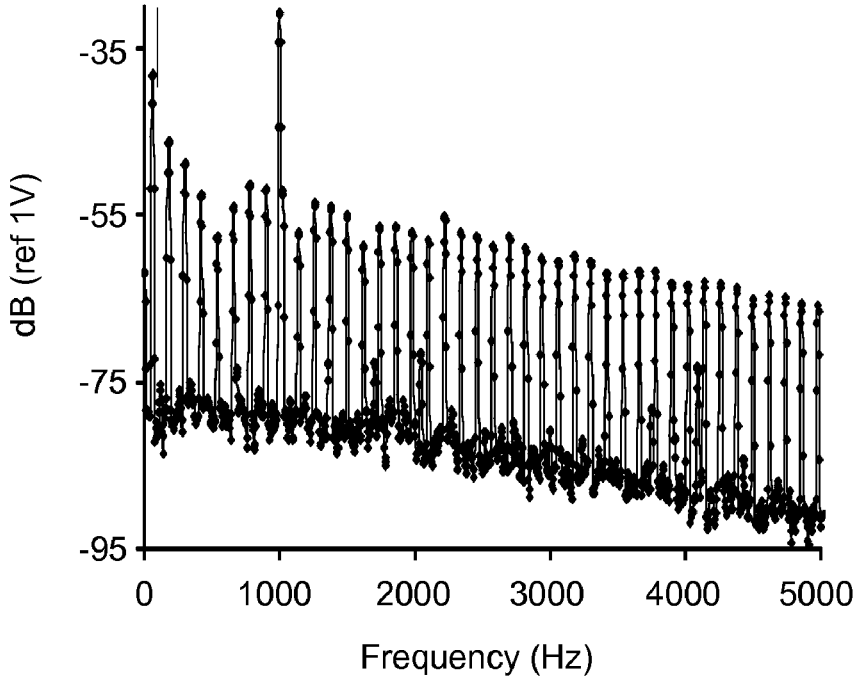
FIGS. 15 and 16 are acoustic measurements demonstrating the harmonic-free operation of the acoustic test setup.
Figure 16:
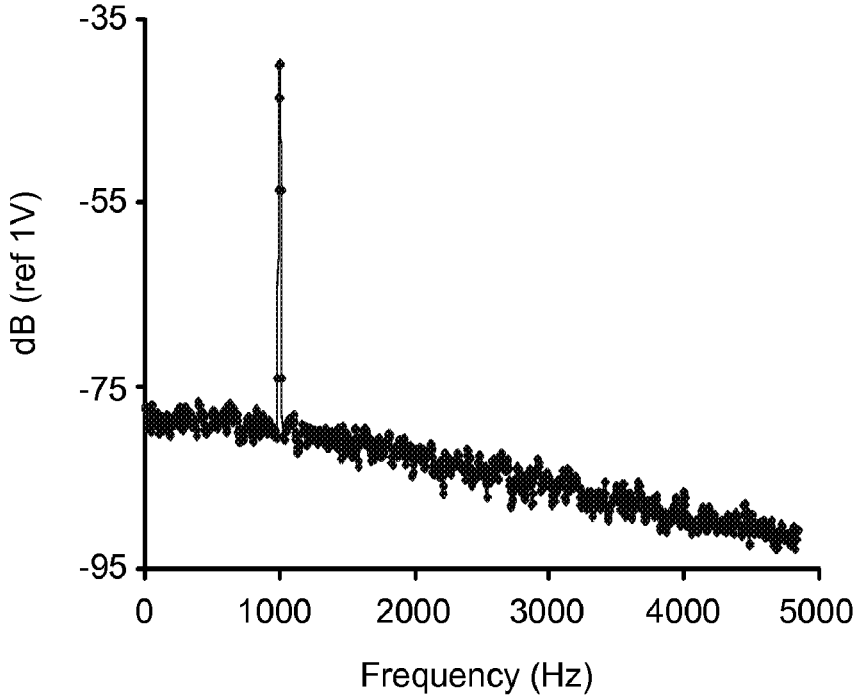

FIG. 15 shows acoustic measurements in an open environment using an unshielded readout circuit powered by DC power supplies with 87 dB input Sound Pressure Level (SPL) at 1 kHz. The unprotected test setup produces RMS noise peaks as high as 25 mVrms at multiples of 60 Hz, and spurs as high as 8 mVrms between 31 kHz and 250 kHz. Fluorescent lighting and high-frequency-switching power supplies used by the measurement equipment are likely to be responsible for noise. Radiating energy from the power grid and leakage through the DC power supply are assumed to be responsible for the 60-Hz noise. Once the acoustic measurement setup is enclosed in a custom-built Faraday cage, no spurs are visible above the noise floor. Agilent DC power supplies are replaced with Li-ion batteries to remove 60-Hz noise originating from the power supplies. Harmonics of the acoustic frequency are observed at the output when the readout circuit is directly exposed to the Knowles microspeaker, suggestive of electromagnetic coupling between the microspeaker and readout circuit amplifier. Additionally, the amplitude of the harmonics varies directly with the proximity of the microspeaker to the readout circuit amplifier. Soldering a grounded copper shield to the readout circuit PCB over the amplifier eliminates the coupling, and harmonics are no longer visible (FIG. 16.)

Figure 17:
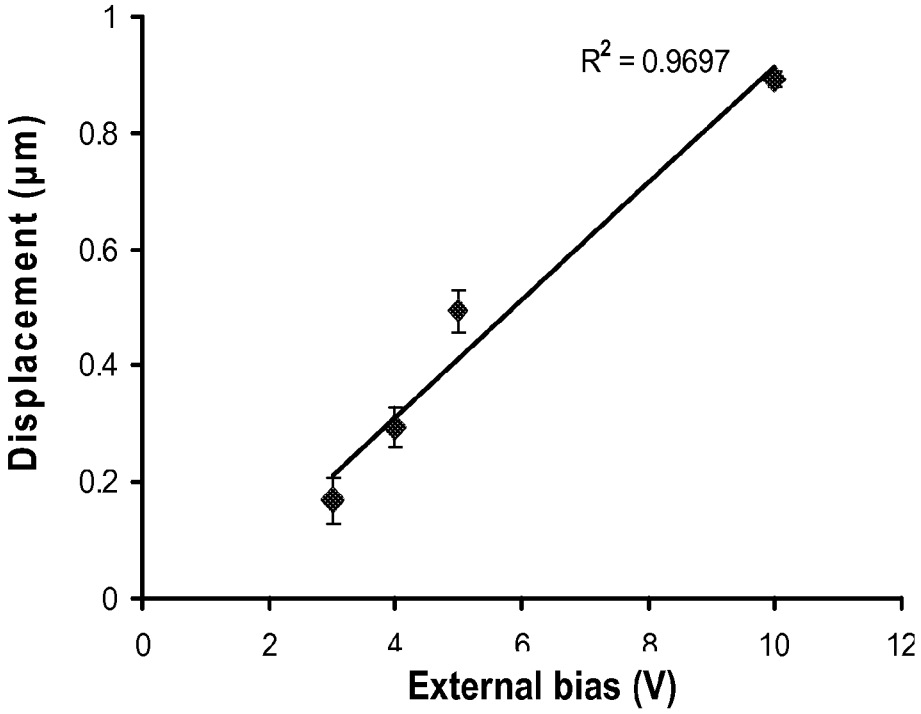
FIGS. 17-20 are measured acoustic data for the microphone element of FIG. 8.
Figure 18:
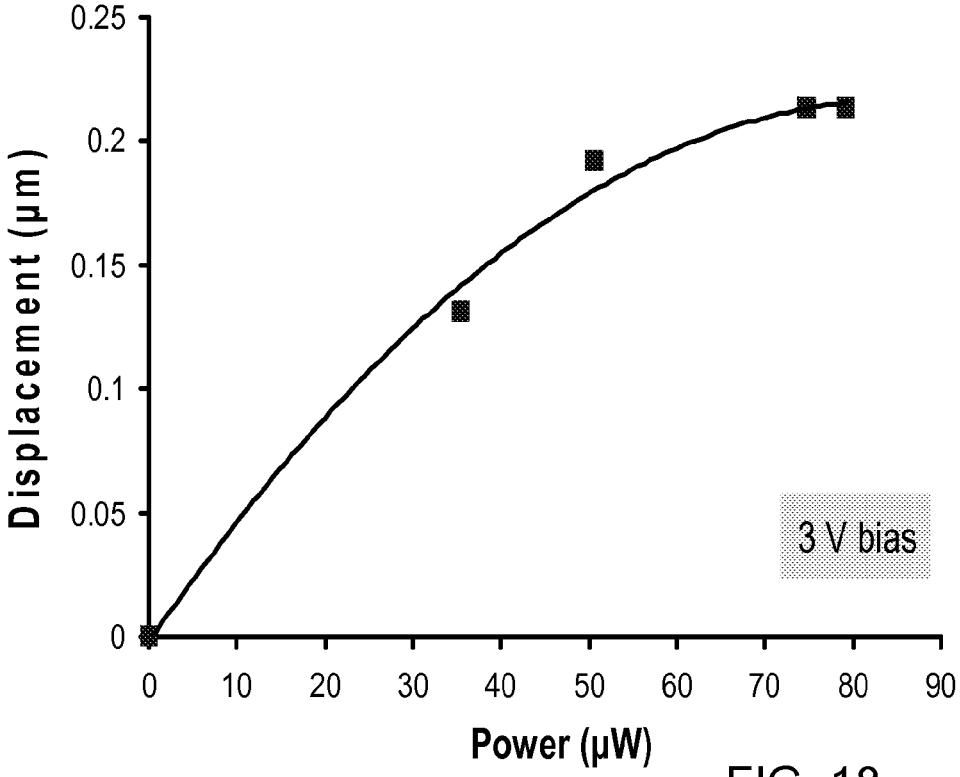

FIG. 17 shows the diaphragm displacement upon growth as a function of tuning parameters. DC voltages from 3 to 10 V are applied for 2 min to grow nano-electrodeposits. The diaphragm displacement is fairly linear as the amplitude of external DC bias voltage; it is proportional to external DC bias on the anode/cathode electrodes, and the regression ($R^2$) for the displacement is 0.9951. As the bias increases to 10 V, the nano-electrodeposits grow rapidly and consequently, the diaphragm displacement drastically increases. FIG. 18 shows low power consumption upon 3-V bias voltage during the growth of the electrodeposits. As the power increases, the diaphragm displacement increases. The maximum displacement reaches 220 nm with approximately 80 μW power consumption.

Figure 19:
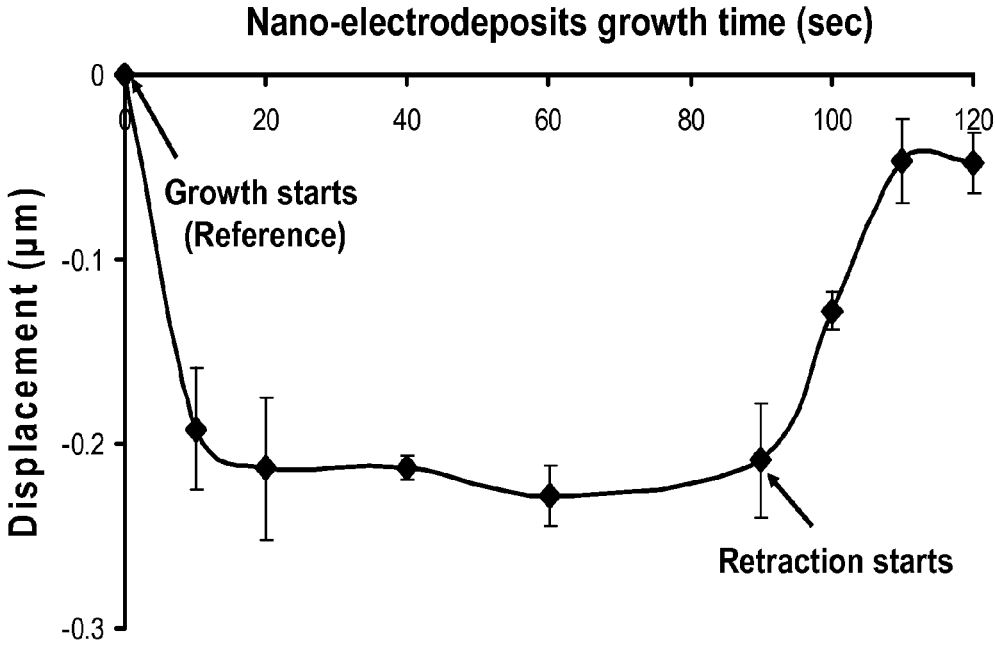

FIG. 19 provides the results of an in-situ diaphragm displacement test as measured at the center of a 1.6 mm diameter parylene diaphragm. The graph of FIG. 19 plots displacement as a function of time for a 3 V bias voltage. During the growth period, the center of the diaphragm displacement increases to 220 nm as the dendritic silver structures grow. This indicates 29% tunability to the effective spring constant of the diaphragm. When the opposite polarity is applied across the anode and cathode, the electrodeposits retract, as shown in the rightmost portion of FIG. 19. When dendritic silver structures are formed below a critical growth point, they can retract completely, causing no obvious hysteresis phenomenon. In some devices, and as shown in FIG. 19, when the dendritic silver structures are grown beyond a critical point, they may not fully retract, causing a hysteresis effect. In the experiment shown in FIG. 19, the displacement decreases back to 50 nm from the initial diaphragm position, not all the way to the initial diaphragm position. Without intending to be bound by theory, the inventors surmise that hysteresis is observed due to residual dendritic silver structures remaining after retraction. The height of these residual dendritic silver structures is approximately 10 nm. Accordingly, in some embodiments of the invention, the spring constant of the diagram is tuned no greater than 20%, no greater than 15%, or even no greater than 10%.

Figure 20:
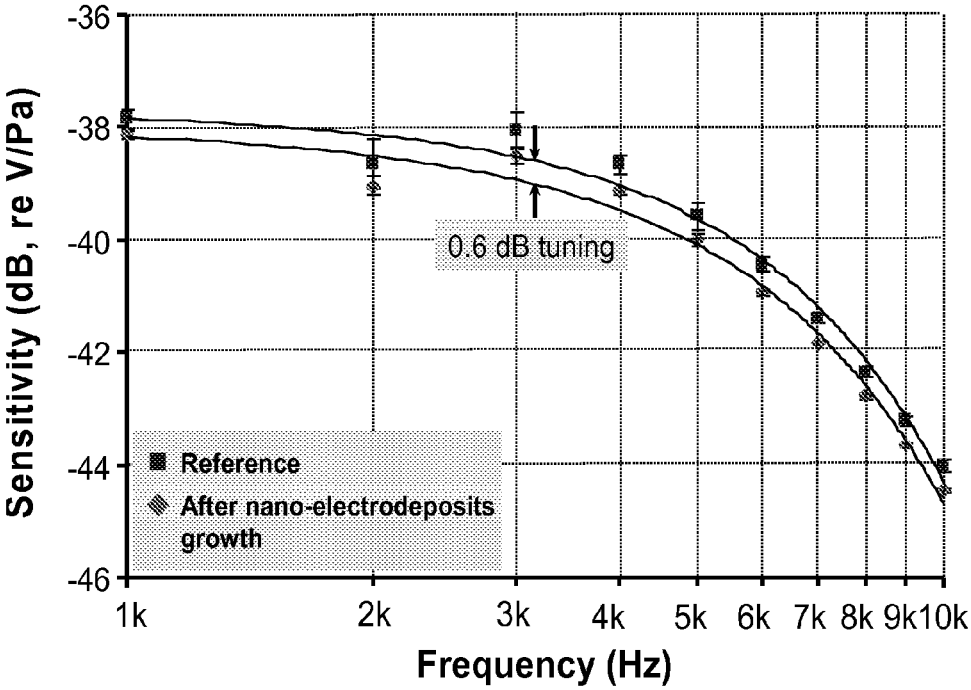

FIG. 20 shows the calibration of the microphone using a microspeaker (FK-6260 from Knowles electronics) providing acoustic inputs from 1 to 10 kHz. The microspeaker is driven with 0.5 V, corresponding to 87 dB SPL. The calibration was performed with a reference microphone (i.e., before tuning by electrodeposition) and its sensitivity through the acoustic readout circuit is in the approximate range of 38-44 dB. The reference microphone was then tuned with 3V DC bias for 30 sec. The tuned microphone sensitivity decreases by 0.6 dB.

Figure 21:
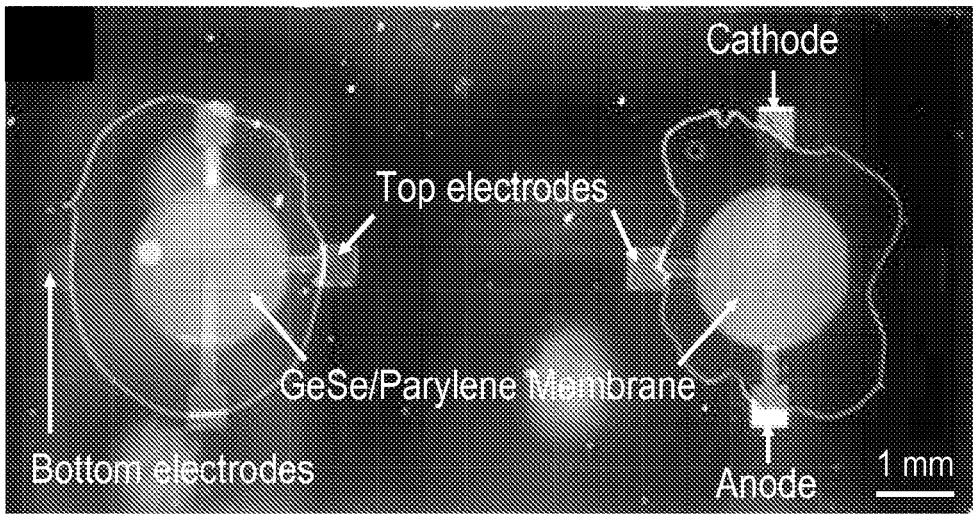
FIG. 21 is a top view of an example of a microphone device according to one embodiment of the invention.

A microphone device with two microphone elements fabricated using methods substantially similar to those described above with respect to FIGS. 6 and 8 is shown in FIG. 21.

Figure 22:
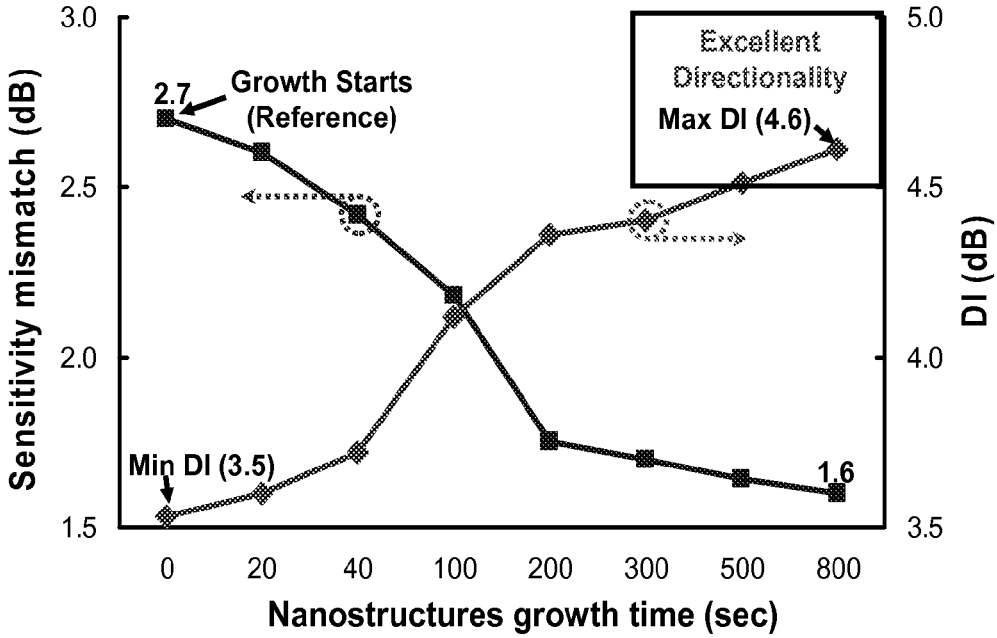
FIGS. 22 and 23 are measured acoustic data for the device of FIG. 21.
Figure 23:
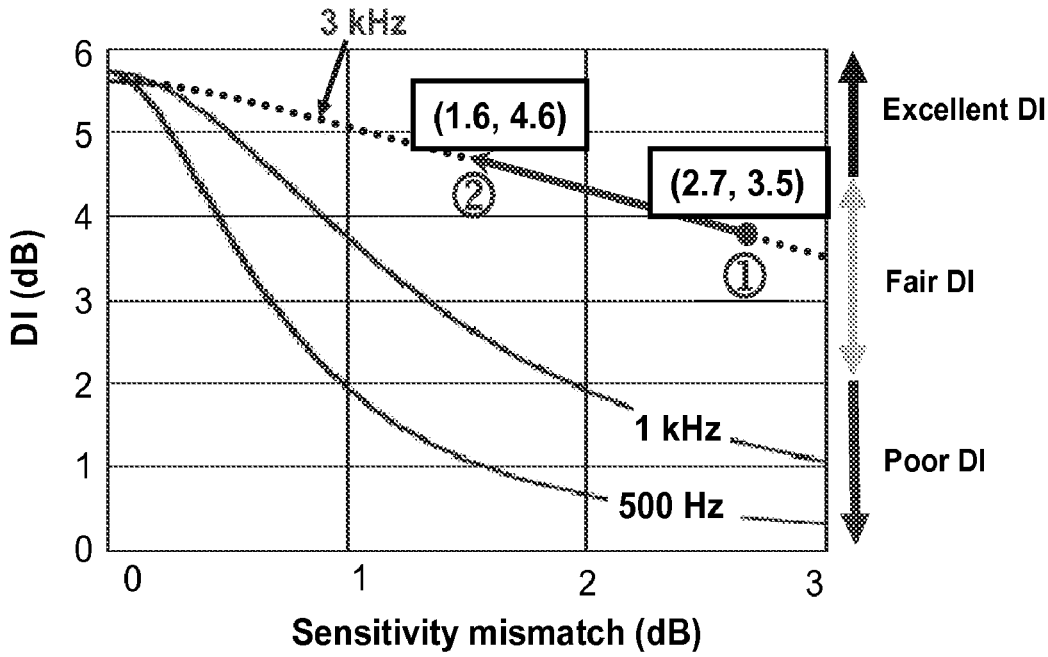

FIG. 22 shows acoustic responses over the growth time of the dendritic silver structures. The mismatch after in-situ tuning reduces from 2.7 dB to 1.6 dB, showing a directional index (DI) increase from 3.5 dB (fair directionality) to 4.6 dB (excellent directionality) at 3 kHz. FIG. 23 shows the relationship between sensitivity mismatch and DI, in which the solid line joining point ① to point ② corresponds to 3 kHz. It represents the reduction in mismatch and the increase in DI from point ① to point ② after the growth of dendritic silver structures. The microphone mismatch can be precisely controlled by in-situ dendritic silver structure growth in a normal operating environment (room temperature/lab environment). These results indicate that if the initial mismatch of non-tuned microphones is small (e.g., as could be achieved with reasonable process control during fabrication of multiple microphone elements on a single substrate), manipulating nanostructures can reduce the mismatch to within 0.25 dB, thereby providing true directionality.

Figure 24:
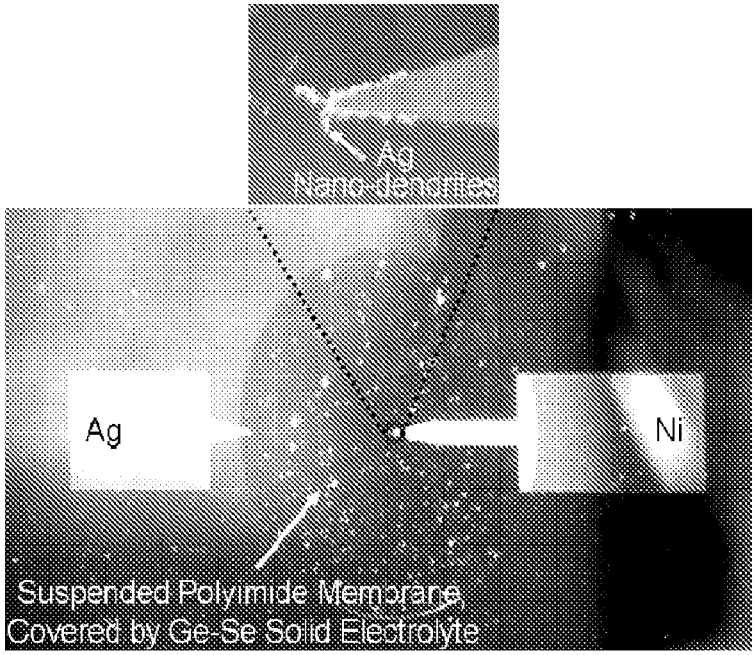
FIG. 24 is a top view of an example of a microphone element according to another embodiment of the invention.
Figure 25:
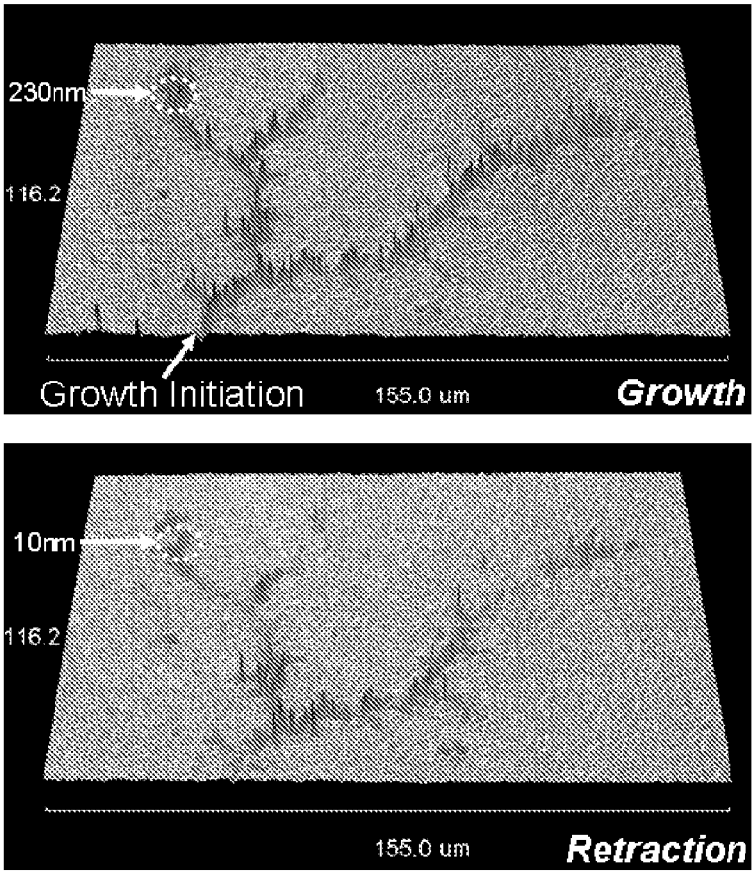
FIGS. 25 and 26 are pictures of the microphone element of FIG. 24 after tuning.
Figure 26:
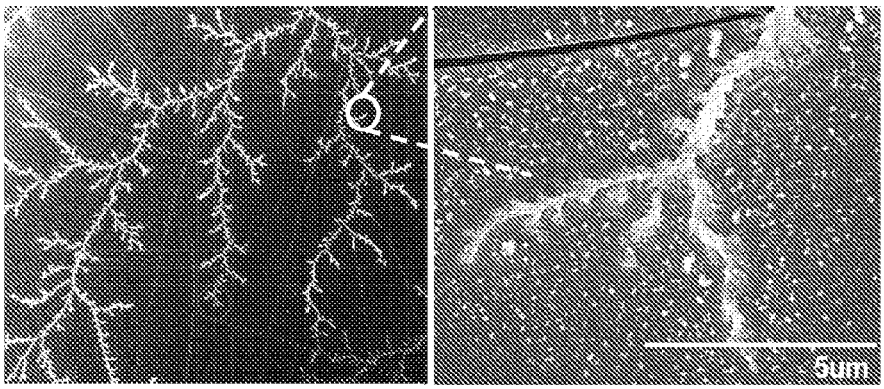
Figure 27:
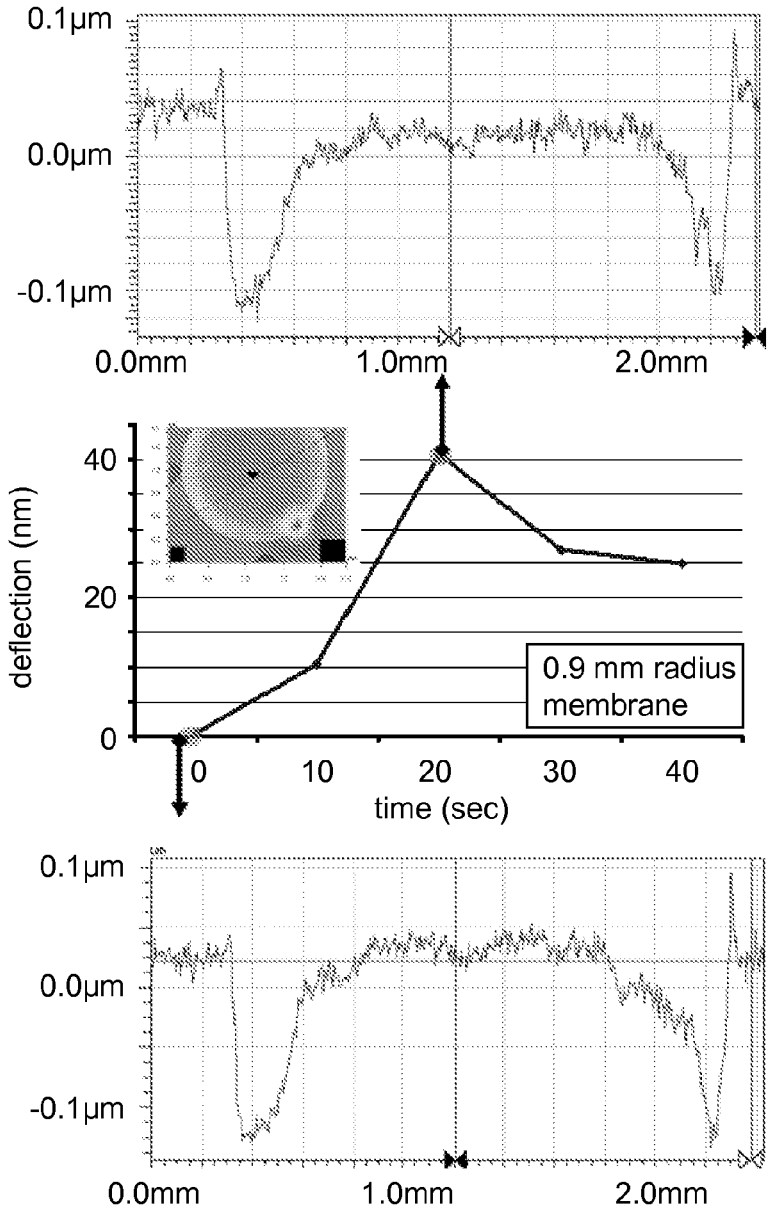
FIGS. 27 and 28 are measured acoustic data for the microphone element of FIG. 24.
Figure 28:
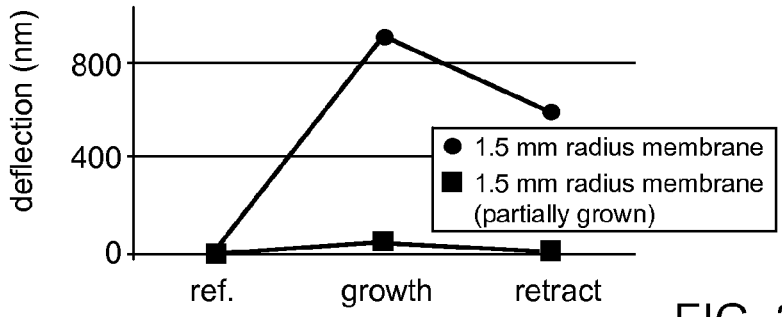

Another example of a fabricated device is shown in FIG. 24. Two electrodes (Ag and Ni) are deposited on top of stacked layers of $SiO_2$, and Ag-doped Ge—Se on a suspended 8 μm thick polyimide membrane. Ag is electrochemically deposited from the Ni cathode tip toward the Ag anode tip by applying a voltage from 2 to 7 V. Three dimensional optical profilometry (Veeco NT9800) shows the silver dendritic structure after growth and refraction (FIG. 25). The thickness of the deposited Ag ranges from tens to hundreds of nanometers, and a 10 nm Ag trace remains after the retraction. Without being bound by theory, the inventors surmise that causes the slight observed hysteresis curve which accounts for an increase in internal mechanical stress upon growth and retraction. The dendritic silver structures on the membrane are shown in FIG. 26. FIG. 27 shows membrane displacements during deposition of dendritic silver structures on a 0.9 mm radius membrane. During the initial stage of growth (<20 s), the membrane displacement increases to 40 nm and then decreases to 25 nm after 40 sec growth. Without being bound by theory, the inventors surmise this phenomenon is due to a combination of mass and stress caused by the electrodeposits. According to a first-order simple analysis, the mass of the nano-structures is not a dominant factor; to bend the membrane by 10 nm, $7.2\times10^{-8}$ kg of Ag is needed, which corresponds to a uniform 2.7 μm thick Ag film. Therefore, the dominant displacement contributor is likely to be stress caused by the dendritic silver structures. FIG. 28 shows the effect of growth and refraction of the dendritic silver structures on a 1.5 mm radius membrane. Due to the remaining 1 g trace after the retraction, slight hysteresis is observed for repetitive growth and retraction.

What is claimed is:

1. A microphone device comprising at least one microphone element, each microphone element comprising a diaphragm suspended by a substrate;

a layer of solid electrolyte disposed on the diaphragm;

an anode electrically coupled to the solid electrolyte; and a cathode electrically coupled to the solid electrolyte; wherein the solid electrolyte is disposed between the anode and the cathode.

2. The microphone device of claim 1, further comprising a dendritic metallic structure extending from the cathode onto the solid electrolyte.

3. The microphone device of claim 2, wherein the anode and the dendritic metallic structure are formed from silver.

4. The microphone device of claim 3, wherein the diaphragm is formed from parylene.

5. The microphone device of claim 4, wherein the diaphragm is operatively coupled to a capacitance-measuring electronic circuit.

6. The microphone device of-claim 5, wherein the microphone device includes at least two of the microphone elements.

7. The microphone device of claim 6, wherein one or more of the microphone elements has a dendritic metallic structure extending from the cathode onto the solid electrolyte.

8. The microphone device of claim 7, wherein one of the microphone elements has a more extensive dendritic metallic structure on its solid electrolyte than does another of the microphone elements.

9. The directional acoustic device of claim 8, wherein the responses of the microphone elements are within 0.1 dB of one another.

10. A method for tuning the microphone device of claim 1, comprising creating an electrical bias between the anode and the cathode to deposit a dendritic metallic structure extending from the cathode onto the solid electrolyte.

11. A method for tuning the microphone device of claim 1, comprising creating a reverse electrical bias between the anode and the cathode to dissolve material from a dendritic metallic structure extending from the cathode onto the solid electrolyte.

12. A method for tuning the microphone device of claim 1, comprising creating an electrical bias between the anode and the cathode to increase the concentration of metal in the solid electrolyte.

13. A method for tuning the microphone device of claim 1, comprising creating a reverse electrical bias between the anode and the cathode to decrease the concentration of metal in the solid electrolyte.

14. The method of any of claims 10-13, wherein the method is performed while measuring the response of the microphone device.

15. A directional microphone device comprising a substrate and at least two microphone elements, each microphone element comprising a diaphragm suspended by the substrate, wherein each microphone element further comprises a layer of solid electrolyte disposed on the diaphragm;

an anode electrically coupled to the solid electrolyte; and a cathode electrically coupled to the solid electrolyte, wherein the solid electrolyte is disposed between the anode and the cathode.

16. The directional microphone device of claim 15 further comprising a capacitive readout circuit operatively coupled to each diaphragm.

17. A hearing aid comprising a hearing aid housing and a directional microphone device as according to claims 15.

18. A method for tuning the directional microphone device of claim 15, comprising creating an electrical bias between the anode and the cathode of at least one of the microphone elements to deposit a dendritic metallic structure extending from its cathode onto its diaphragm.

19. A method for tuning the microphone device of claim 15, comprising determining which microphone element has lower sensitivity; then creating an electrical bias between the anode and the cathode of the less sensitive microphone element to deposit a dendritic metallic structure extending from its cathode onto its diaphragm.

* * * * *